US011564517B2

(12) United States Patent
Wolfe

(10) Patent No.: US 11,564,517 B2
(45) Date of Patent: Jan. 31, 2023

(54) DRINKING CUP WITH UTENSIL COMPARTMENT INTEGRATED WITH HANDLE

(71) Applicant: Ryan Wolfe, Orlando, FL (US)

(72) Inventor: Ryan Wolfe, Orlando, FL (US)

( * ) Notice: Subject to any disclaimer, the term of this patent is extended or adjusted under 35 U.S.C. 154(b) by 114 days.

(21) Appl. No.: 15/929,730

(22) Filed: May 19, 2020

(65) Prior Publication Data

US 2021/0361099 A1 Nov. 25, 2021

(51) Int. Cl.
*A47G 19/22* (2006.01)
*A47G 21/06* (2006.01)

(52) U.S. Cl.
CPC ..... *A47G 21/06* (2013.01); *A47G 19/2205* (2013.01)

(58) Field of Classification Search
CPC .... B65D 51/246; B65D 23/12; B65D 77/245; A47G 21/145; A47G 21/06; A47G 19/2205; A45F 3/46; A47J 47/16; A47J 43/287
USPC ..... 248/37.6, 37.3; 206/349, 217; 211/70.1
See application file for complete search history.

(56) References Cited

U.S. PATENT DOCUMENTS

| | | | | |
|---|---|---|---|---|
| 1,420,297 | A * | 6/1922 | Thompson | A47G 19/2222 215/391 |
| 2,918,203 | A | 12/1959 | Hodgson | |
| 3,069,046 | A * | 12/1962 | Gram | A47G 19/2205 215/383 |
| 6,871,995 | B2 | 3/2005 | Simba | |
| 7,971,774 | B2 | 7/2011 | Yaloz et al. | |
| 8,136,694 | B1 * | 3/2012 | Vieau | B65D 25/2814 220/735 |

FOREIGN PATENT DOCUMENTS

| | | | |
|---|---|---|---|
| CN | 2042327 | U | 8/1989 |
| CN | 102240129 | A | 11/2011 |
| CN | 102309228 | A | 1/2012 |
| CN | 102423223 | A | 4/2012 |
| DE | 20305673 | U1 | 8/2003 |
| KR | 20110001814 | U | 2/2011 |
| KR | 200480933 | Y1 | 7/2016 |

* cited by examiner

*Primary Examiner* — King M Chu
(74) *Attorney, Agent, or Firm* — Mark Young, PA

(57) ABSTRACT

A drinking cup assembly includes a handle with a compartment for storing a utensil. The utensil includes a panel that forms a part of the handle. When the utensil is contained in the compartment, the panel occupies an opening that leads to the compartment. The utensil may be a stirrer, spoon, fork or knife. The handle may be permanently attached to the cup or removable from the cup.

20 Claims, 13 Drawing Sheets

DRINKING CUP WITH UTENSIL COMPARTMENT INTEGRATED WITH HANDLE

FIELD OF THE INVENTION

This invention relates generally to drinking cup, and, more particularly, to a cup with a handle with a removable panel attached to a utensil contained in a compartment in the handle.

BACKGROUND

The countless items of plastic waste polluting oceans, lakes, and rivers and piling up on land is more than unsightly, it is harmful to plants and wildlife. Single-use plastics, such as straws, utensils and plastic bottles, comprise a significant part of the pollution.

World plastics production increased from about an estimated 200 million metric tons in 2002 to 348 million metric tons in 2017, and continues to increase. Roughly half of annual plastic production is destined for single-use products, which include plastic straws, bottles, cups and utensils. Only a small portion is ever recycled, with the balance ending up in landfills, oceans, and elsewhere.

As one example, more than 480 billion plastic drinking bottles were sold in 2016 across the world, up from about 300 billion a decade ago. By 2021 this amount is expected to increase to 583.3 billion. Most plastic bottles used for beverages are made from polyethylene terephthalate (PET), which is highly recyclable. But as their use soars, efforts to collect and recycle the bottles are failing to keep up. Fewer than half of the bottles are collected for recycling and a small percentage of those collected are turned into new bottles. Most plastic bottles produced end up in landfill or in the ocean. The percentages of plastic straws, cups and utensils that are collected and recycled are even lower. As these items tend to be discarded as trash, with other food waste.

Efforts have been made to devise containers with a compartment for storing utensils. Cups or similar containers with a lid having a storage compartment in which one or more utensils are contained are describe in U.S. Pat. Nos. 3,624,787, 3,679,093, 4,930,637, 5,042,712, 5,090,572, 5,705,212 and 5,992,667 and US Patent Application Publication 20010002673. Many of these are disposable cups or containers packaged with disposable utensils. They are part of the problem. They do not provide a means for storing utensils in a cup while the cup is used and remains fully functional. They do not provide means for removing, restoring and securing the utensils in a separate compartment. They do not solve the problem of single use disposable plastic utensils and cups.

A cup with a compartment for holding a utensil should allow use of the cup while the utensil is stored or removed. Such a cup should store the utensil in a compartment apart from the beverage compartment of the cup. The compartment containing the utensil should not interfere with use of the cup. Such a cup should securely hold the utensil, preventing rattling of the utensils when the cup is moved. The compartment containing the utensil should include a closure to prevent soiling and contamination. The utensil should be easy to remove from the compartment. The stored utensil should not detract from the aesthetics of the cup.

The invention is directed to overcoming one or more of the problems and solving one or more of the needs as set forth above.

SUMMARY OF THE INVENTION

To solve one or more of the problems set forth above, in an exemplary implementation of the invention, a drinking cup assembly includes a handle with a compartment for storing a utensil. The utensil includes a panel that forms a part of the handle.

An exemplary drinking cup assembly according to principles of the invention includes a cup having a bottom, an open top leading to a volume for containing a liquid, and a sidewall (single-walled or multi-walled) extending from the bottom and defining the volume and the open top. The sidewall has an inner side and an outer side. A handle includes a first segment extending radially from the outer side of the sidewall. The first segment includes a proximal end attached to the sidewall and a distal end opposite the proximal end. A second segment extends downwardly from the distal end of the first segment. The second segment hs a top connected to the first segment and a bottom opposite the top. The second segment has an interior compartment. The top of the second segment includes an opening leading to the interior compartment. The opening includes a first edge at the distal end of the first segment and a second edge at the top of the second segment. Each of the first segment and the second segment of the handle has an outer surface. A utensil includes a panel and a utensil body (e.g., a stirrer, spoon, fork or knife) attached to and extending from the panel. The utensil body is sized to fit in the interior compartment of the second segment. The panel is sized and shaped to occupy the opening leading to the interior compartment when the utensil body is contained in the interior compartment of the second segment. The panel seamlessly integrates with the handle. The panel forms a portion of the handle when the utensil body is contained in the interior compartment of the second segment. The panel is curved and forms a transition from the first segment of the handle to the second segment of the handle when the utensil body is contained in the interior compartment of the second segment. The handle has a width at the top of the second segment. The opening also has a width. In one embodiment, the width of the opening does not exceed the width of the top of the second segment.

The opening includes a proximal edge, a distal edge and a pair of spaced apart side edges that extend from the proximal edge to the distal edge. Each of the proximal edge and distal edge have an elevation (e.g., an outermost point of the surface). The panel also includes a proximal edge, a distal edge and a pair of spaced apart side edges that extend from the proximal edge to the distal edge. Each of the proximal edge and distal edge also have an elevation. The elevation of the proximal edge of the opening is about the same as the elevation of the proximal edge of the panel when the utensil body is contained in the interior compartment of the second segment. Likewise, the elevation of the distal edge of the opening is about the same as the elevation of the distal edge of the panel when the utensil body is contained in the interior compartment of the second segment. Except for discontinuities between the abutting or adjacent edges of the panel and the opening, the panel and adjacent portions of the handle appear to be continuous and integrated (i.e., seamlessly integrated).

The invention includes many optional variations. The first segment of the handle may be solid or hollow. The handle may be permanently attached to the sidewall of the cup or removably attached to the sidewall of the cup with an attachment. Such an attachment may be a snap-fit coupling or a flange and a screw. The utensil body may be a stirrer, fork, spoon or knife. The utensil body may be permanently attached to the panel or releasably attached to the panel. The sidewall may be a multi-walled structure with at least two spaced apart layers or a single layer structure. A stop may be provided at the opening to limit insertion of the panel into the opening.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

A drinking cup assembly 100 according to principles of the invention includes a compartment in a handle for storing a utensil. The utensil is attached to a panel that forms part of the handle when the utensil is stored in the handle. In some embodiments, the handle is removable from the cup, such as to facilitate storage in a cup holder of a vehicle.

Figure 1:
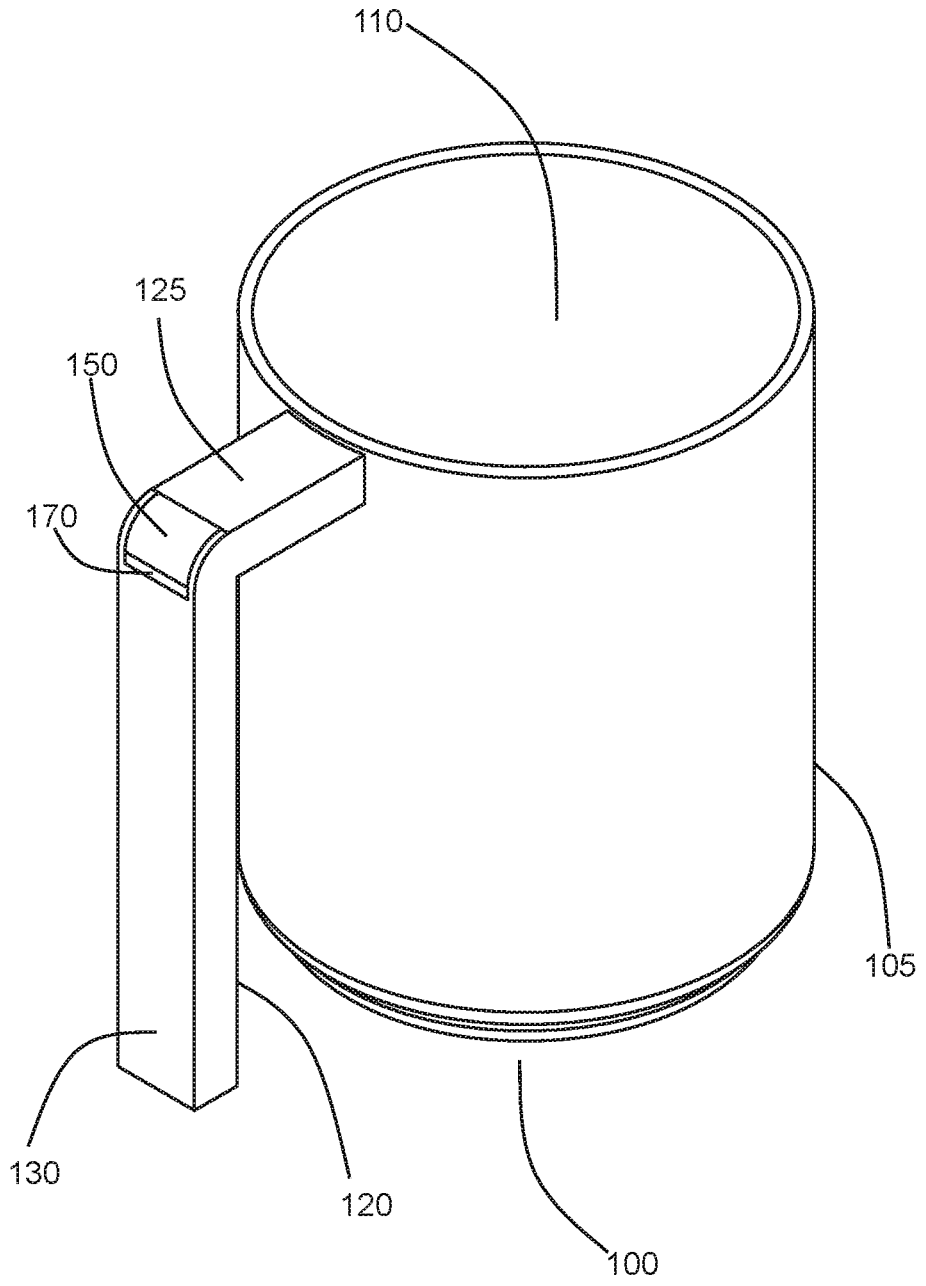
FIG. 1 is a perspective view of an exemplary drinking cup according to principles of the invention.
Figure 2:
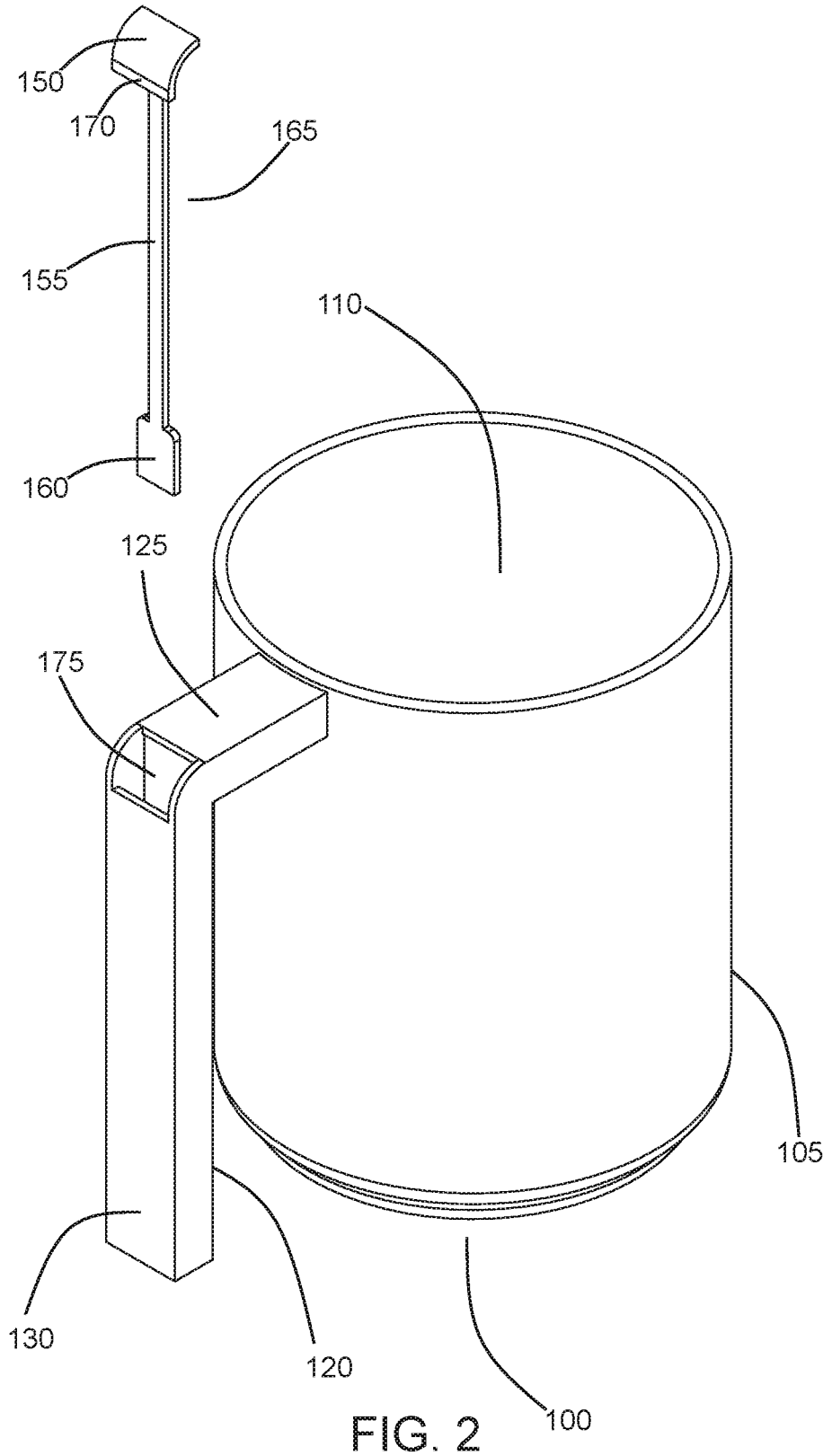
FIG. 2 is an exploded perspective view of an exemplary drinking cup according to principles of the invention.

FIGS. 1 and 2 conceptually illustrate an exemplary drinking cup assembly 100 according to principles of the invention. The assembly includes a cup 105 with an open top 110. The invention is not limited to the particular illustrated shape and proportions of the cup. By way of example, a taller cup may be used without departing from the scope of the invention.

The assembly 100 includes a handle 120. The handle 120 may be permanently attached to the cup 105 or removable from the cup 105. In each embodiment, the handle includes at least one segment 125 that extends radially from the outside of the cup 105. This segment of the handle 120 is referred to as the horizontal segment 125, even if the segment is not precisely horizontal. Another segment 130 of the handle 120 extends downwardly or orthogonally from the horizontal segment 125. This segment 130 of the handle 120 is referred to as the vertical segment 130, even if the segment is not precisely vertical. Together, the horizontal segment 125 and vertical segment 130 produce a generally L-shaped handle, with the L being upside down.

In another embodiment, the handle 120 may generally have a C-shape. In this embodiment, another horizontal segment may extend radially from the outside of the cup 105, aligned with the upper horizontal segment 125, and attach to the bottom of the vertical segment 130. In this embodiment, the handle 120 may be permanently or removably attached to the cup 105.

The assembly 100 includes a drinking cup 105. The exemplary drinking cup 105 is generally tubular with an open end (e.g., the top) and a closed end (i.e., the bottom). The cup 105 defines a cylindrical compartment 110 for containing a beverage. The invention is not limited to a particular shape or size cup or compartment. Any cup suitable for containing a beverage and having a handle may be used within the spirit and scope of the invention.

Figure 4:
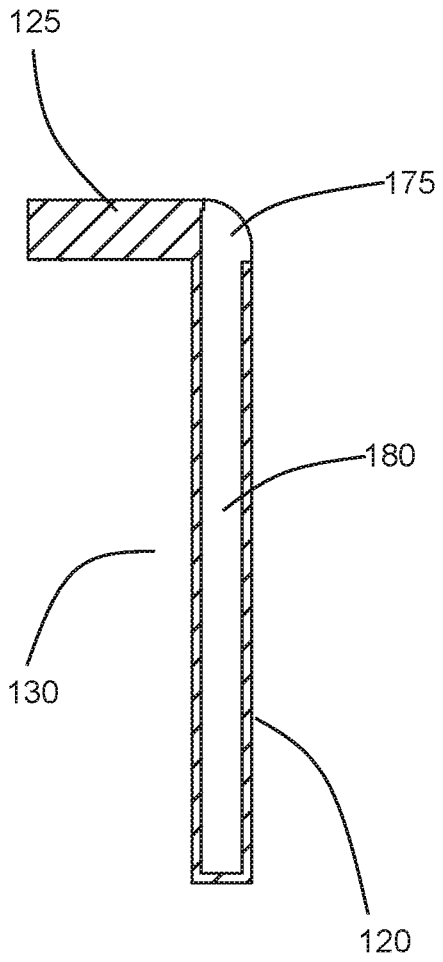
FIG. 4 is a section view of an exemplary handle with a compartment for an exemplary drinking cup according to principles of the invention.
Figure 5:
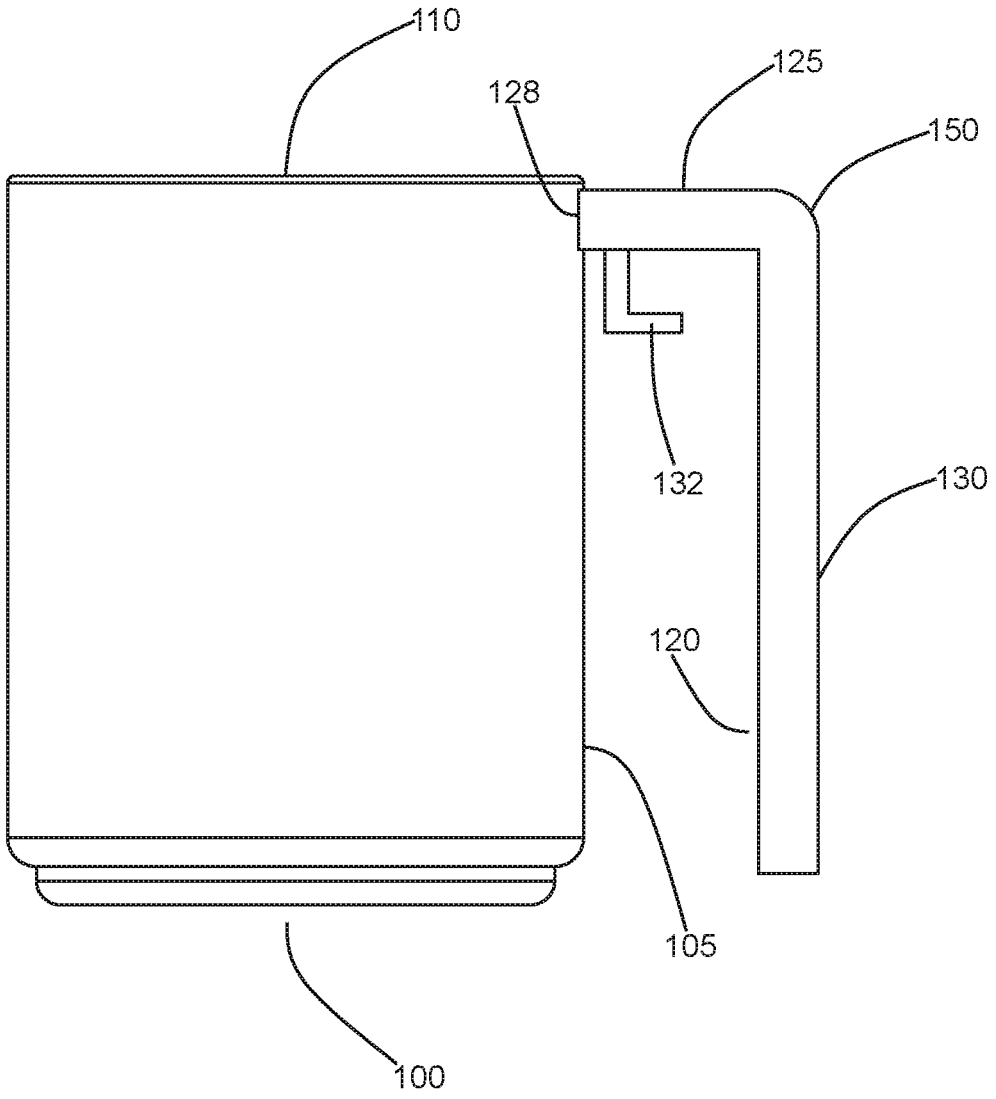
FIG. 5 is a profile view of an exemplary drinking cup with a removable handle according to principles of the invention.
Figure 6:
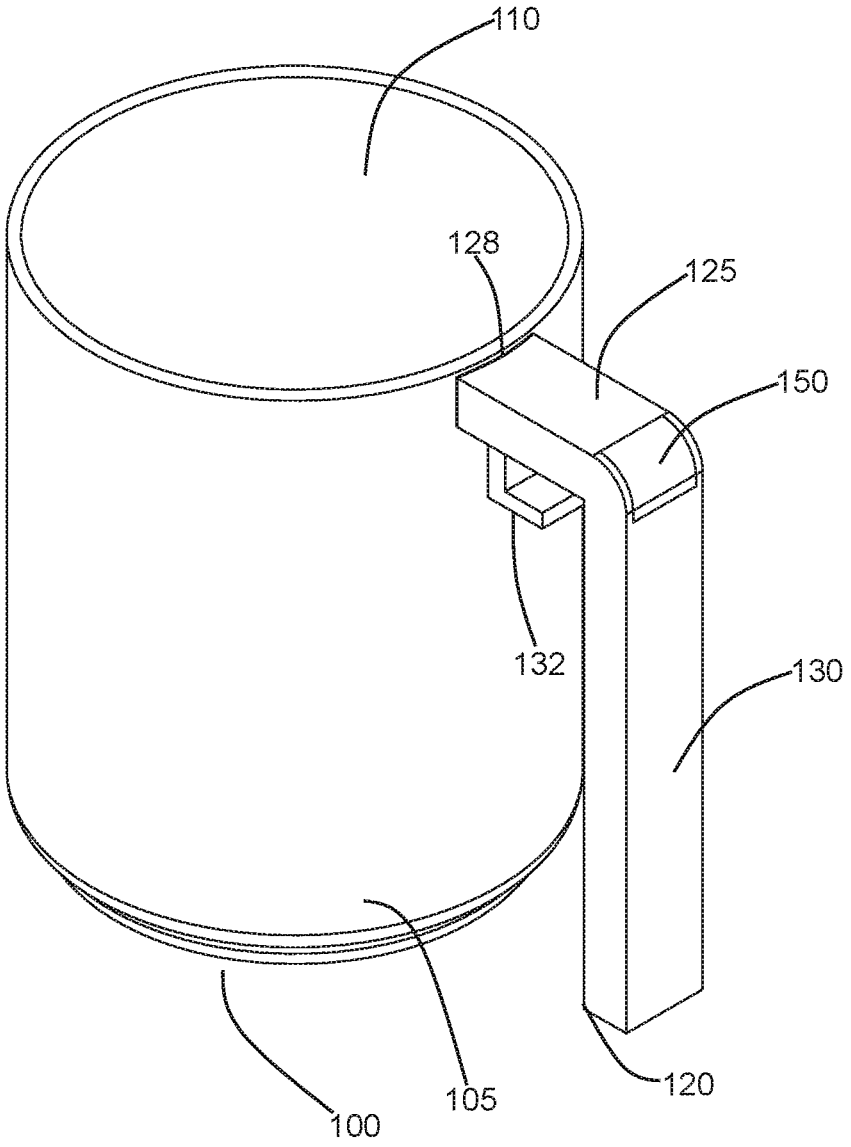
FIG. 6 is a perspective view of an exemplary drinking cup with a removable handle according to principles of the invention.
Figure 7:
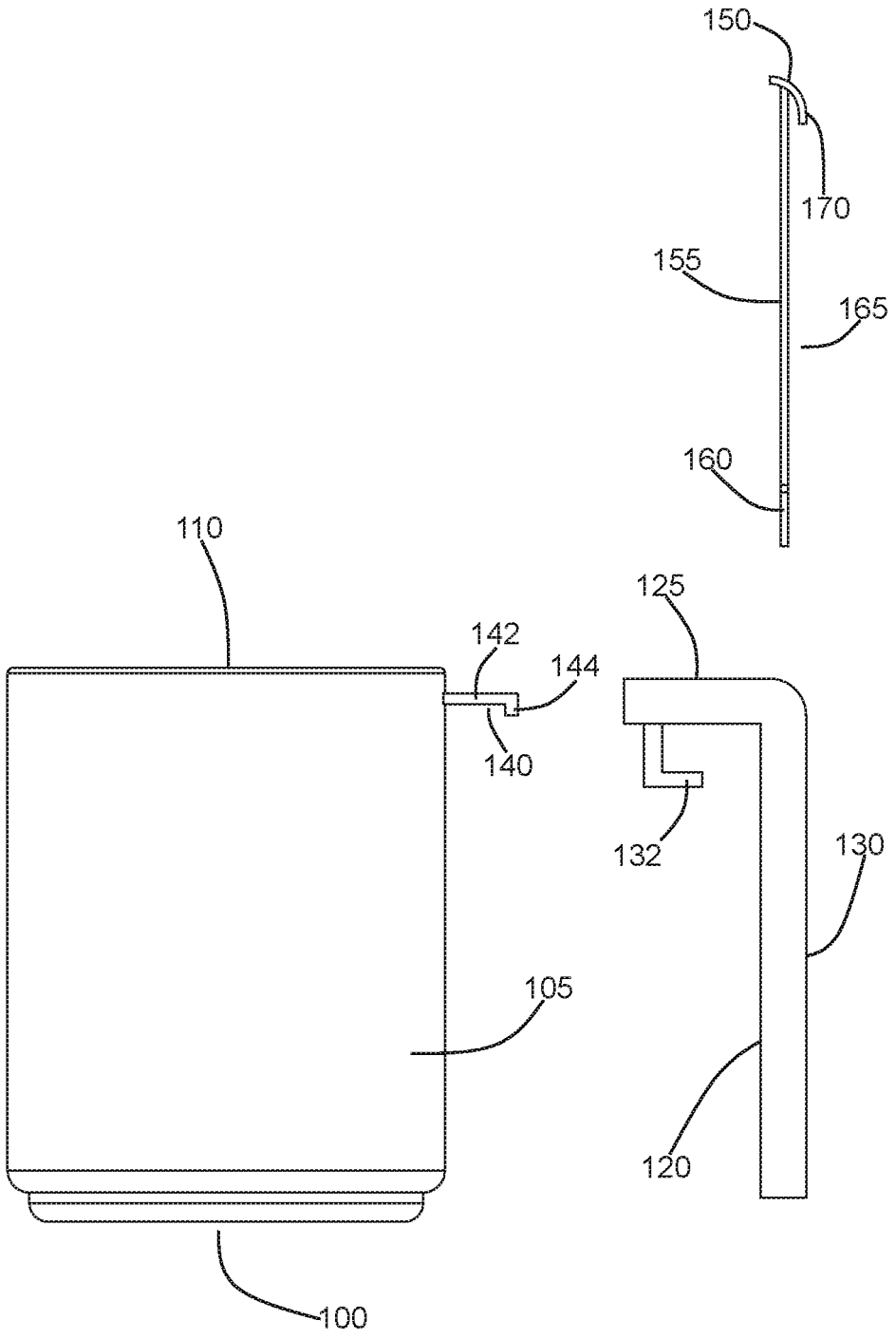
FIG. 7 is an exploded profile view of an exemplary drinking cup with a removable handle according to principles of the invention.
Figure 8:
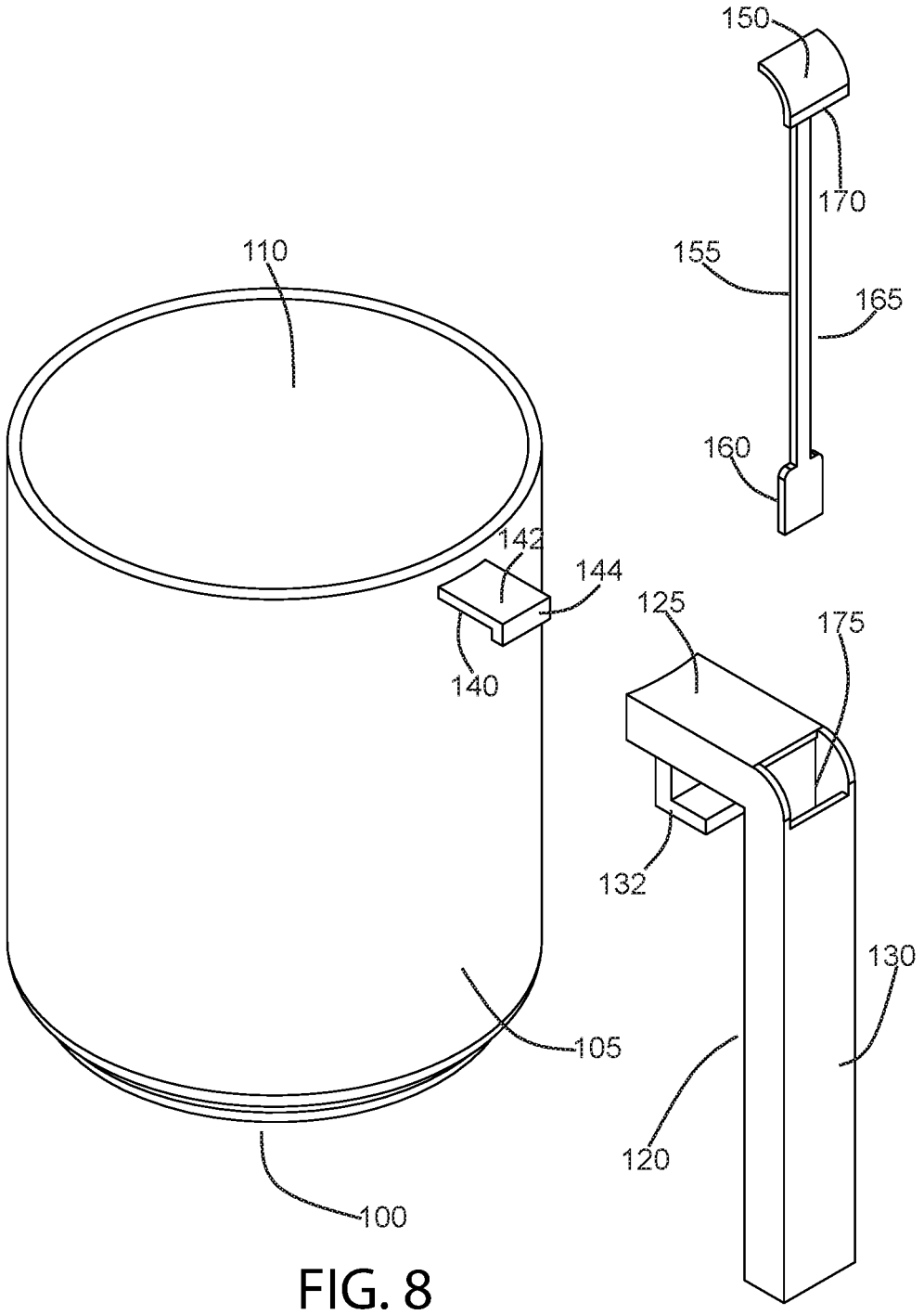
FIG. 8 is an exploded perspective view of an exemplary drinking cup with a removable handle according to principles of the invention.
Figure 9:
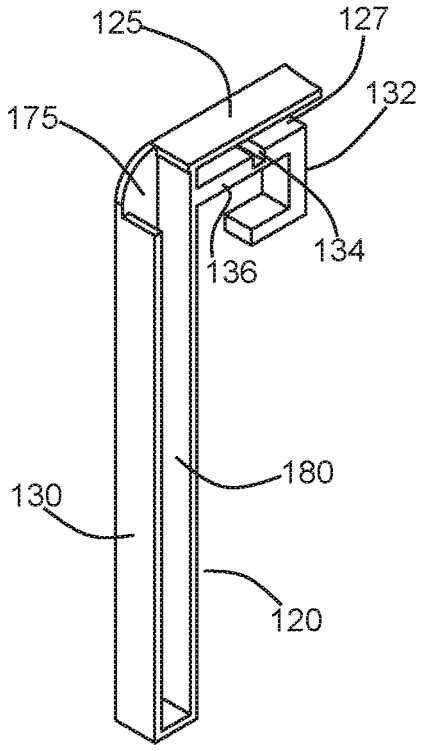
FIG. 9 is a perspective section view of an exemplary removable handle for an exemplary drinking cup according to principles of the invention.
Figure 10:
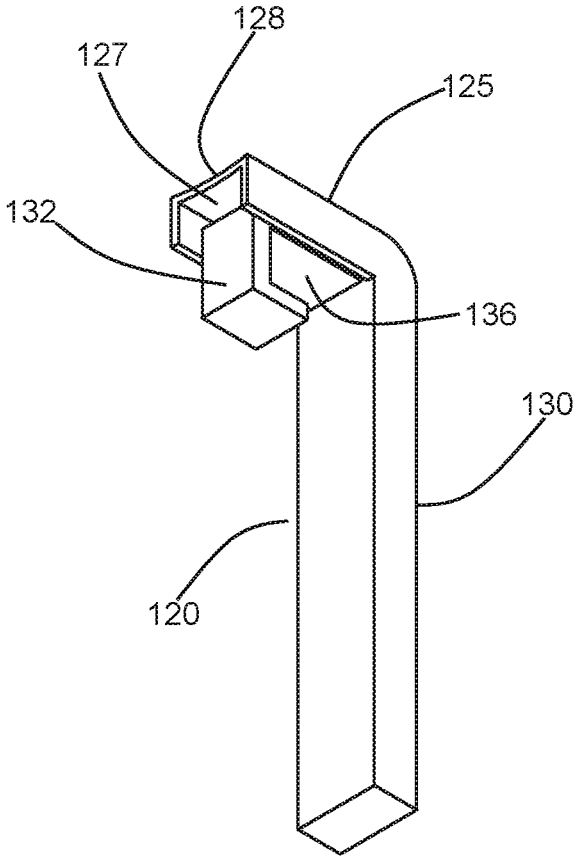
FIG. 10 is a perspective view of an exemplary removable handle for an exemplary drinking cup according to principles of the invention.
Figure 11A:
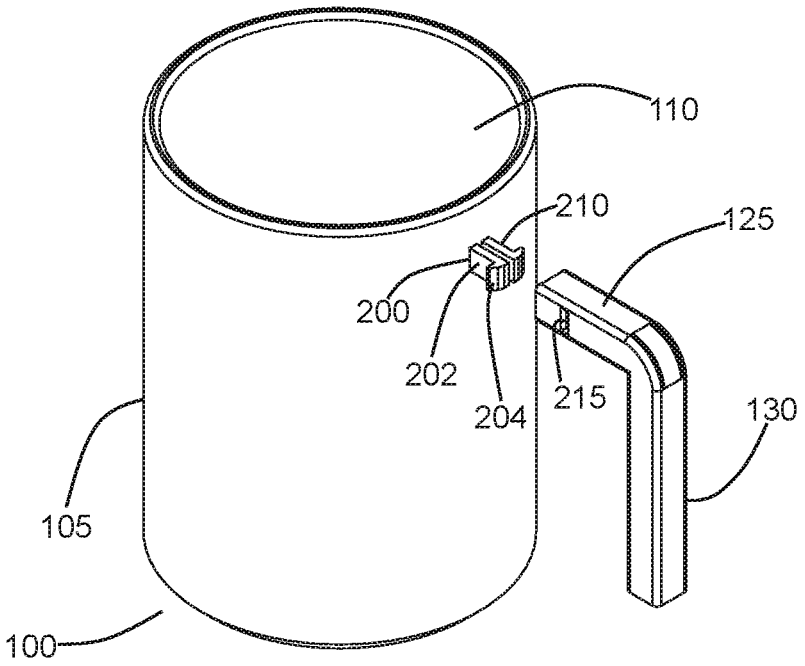
FIG. 11A is a perspective view of an exemplary removable handle apart from an exemplary drinking cup according to principles of the invention.
Figure 11B:
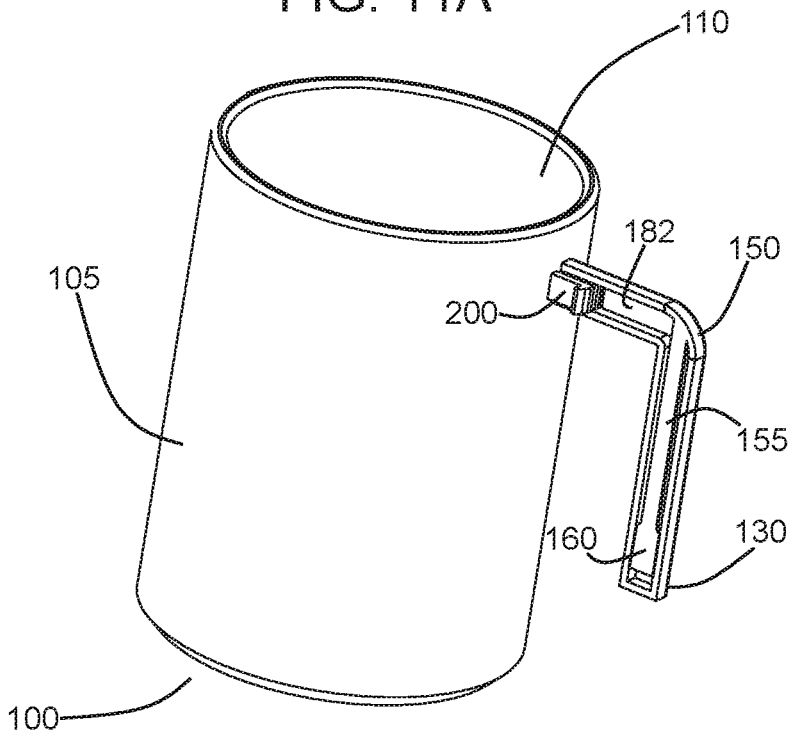
FIG. 11B is a perspective section view of the exemplary removable handle of FIG. 11A attached to the exemplary drinking cup of FIG. 11A according to principles of the invention.

The exemplary handle 120 includes a hollow segment 130, i.e., vertical segment 130. The segment 130 is sufficiently long to receive a utensil 165 in an interior compartment 180 (FIG. 4). The interior compartment 180 is accessible through an opening 175 at the top of the segment 130.

Figures 3A, 3B, 3C:
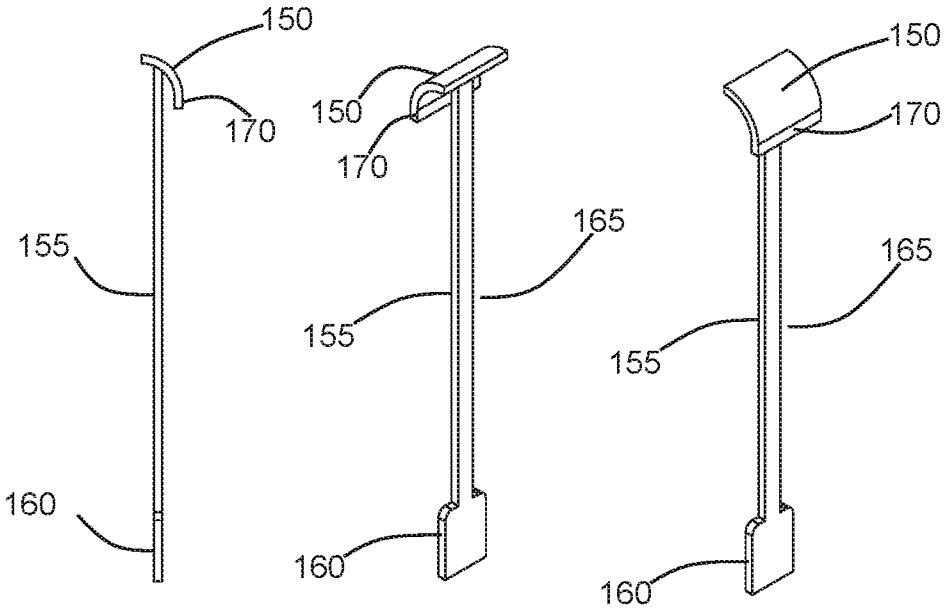
FIGS. 3A, 3B and 3C are views of an exemplary utensil for an exemplary drinking cup according to principles of the invention.

In the exemplary embodiment, the utensil 165 is a stirrer. The stirrer 165 (FIGS. 3A, 3B, and 3C) includes a handle panel 150, a handle 155 and a base 160. The handle 155 extends from the underside of the panel 150 to the base 160. The handle 155 is attached to the underside of the panel 150 and to the base 160. In the exemplary embodiment, the panel 150 optionally includes a protruding or recessed edge 170 to facilitate removal with a fingernail or fingertip.

The utensil 165 is not limited to the depicted stirrer 165. By way of example and not limitation, the utensil may comprise a spoon, fork or knife. Each such utensil may be used for its primary purpose, as a spoon, fork or knife, but also as a stirrer. In each case, the utensil is attached to and extends from a panel 150. The panel 150 is seated at and covers the opening 175 when the utensil is contained in the compartment 180 of the hollow segment 130 of the handle 120. The panel 150 may be removed from the opening 175 by simple manipulation with a finger, fingertip or fingernail. Such removal exposes the utensil, which then may be easily withdrawn from the compartment 180. Likewise, after use, the utensil may be easily be inserted into the compartment 180 until the panel is seated at the opening 175.

Figure 13:
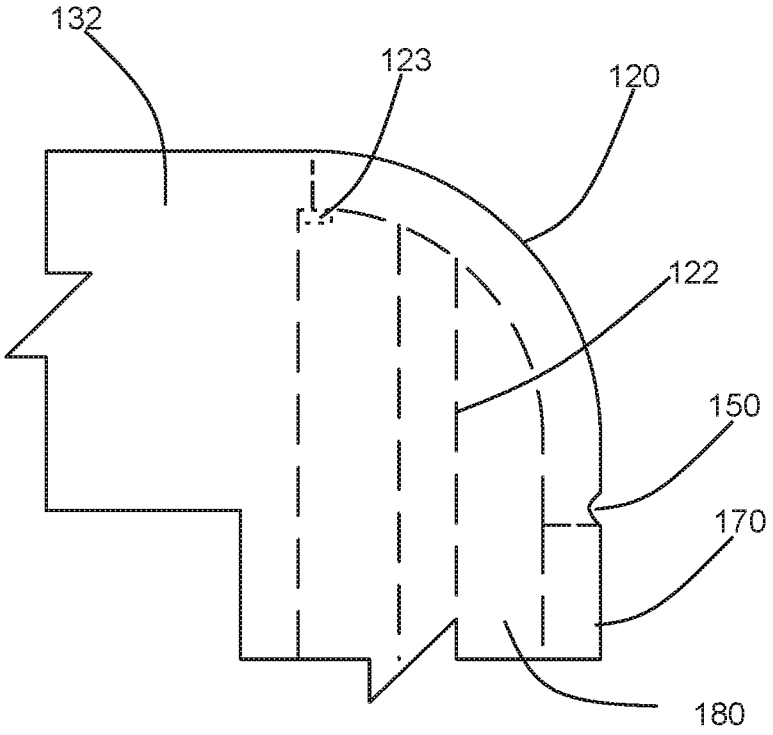
FIG. 13 is a magnified profile view of the panel covering the opening of a compartment in the handle of a cup according to principles of the invention.

In the exemplary embodiment, the panel 150 is located at the outer side of the handle 120. The panel 150 is located at a bend that forms a transition from the horizontal segment 125 to the vertical segment 130. In the exemplary embodiment, the width of the panel 150 is less than or equal to the width of the handle 120 at the bend. Optionally, the panel 150 may also encompass portions of the side surfaces of the handle. The shape of the panel 150 is approximately the same as the shape of the area of the handle 120 that would be occupied by the panel if the handle 120 was solid, as shown in FIG. 13. As further shown in FIG. 13, the outer surface of the panel 150 is even with the outer surfaces of the handle 120. Additionally, one or more stops 152 may be provided in the handle 120 beneath the opening 175 to limit insertion of the panel 150. The panel 150 may fit snugly in the opening 175. Additionally, a snap-fit releasing lock may be provided on the panel and beneath the opening to resist unintended dislodging of the utensil 165.

The panel 150 attached to the utensil 165 provides several advantages. One advantage is ease of access to the utensil 165. Another advantage is that the utensil and panel are one component. Additional separate pieces (e.g., a separate compartment cover) are avoided. Yet another advantage is the avoidance of rattling. A loose utensil in a compartment may rattle. The utensil attached to the panel 150 is far less likely to rattle. Further advantages are aesthetics and ergonomics. The panel 150 integrates with the handle 120, thereby avoiding unsightly features that may interfere with gripping and use.

The invention is not limited to a particular material for the handle 120. The handle 120 may be comprised of any suitable material. In one embodiment, the handle 120 comprises plastic. In other embodiments, the handle 120 may comprise metal, ceramics, glass, or combinations of any of the foregoing.

The drinking cup 105 includes an outer surface and an interior surface. The interior surface defines the compartment, cavity, space 110 that may contain a beverage. In a nonlimiting exemplary embodiments, the drinking cup is a single-walled or a multi-walled vessel. By way of example and not limitation, the drinking cup 105 may be a double-walled stainless steel vessel, with insulation, evacuated space, air or another gas between the walls. Alternatively, the drinking cup 105 may be single walled. As another alternative, the drinking cup may be comprised of glass or a plastic that is safe for food contact. Nonlimiting examples of such plastics include polyethylene terephthalate, high density polyethylene, low density polyethylene and polypropylene.

Referring to FIGS. 5-10, an embodiment with a removable handle 120 is conceptually illustrated. The handle 120 may be removed to facilitate storage of the drinking cup in a cup holder, such as a cup holder of a vehicle. In this embodiment, the horizontal segment 125 includes a compartment 127 with a flexible cantilever beam 136, with a notch 134 and a trigger 132. Another cantilever beam 140 with a horizontal portion 142 and a flanged end 144 extends radially, from the outer side of the cup 105 where the handle 120 attaches. This cantilever beam 140 is substantially rigid. The beam 140 extending from the cup is received in the compartment 127 until the flange 144 is seated in the notch 134 of the cantilever beam 136 of the handle 120. As the beam 140 extending from the cup is received in the compartment 127, the flange 144 deflects the cantilever beam 136 of the handle 120, until the flange 144 is seated in the notch 134 of the cantilever beam 136 of the handle 120. When the flange 144 is seated in the notch 134 of the cantilever beam 136 of the handle 120, the handle 120 is attached to the cup 105 and may be used, in any ordinary manner, without detachment. Such normal use, even with a cup 105 filled with a beverage, does not exert sufficient force to deflect the cantilever beam 136 of the handle 120 sufficiently to release the flange 144 from the notch 134.

A release trigger 132 is provided to facilitate deflecting the cantilever beam 136 of the handle 120 sufficient to release the flange 144 from the notch 134. The release trigger 132 extends downwardly from the leading edge of the cantilever beam 136 of the handle 120. the cantilever beam 136 of the handle 120 is opposite the upper surface 128 of the horizontal segment 125 of the handle 120. The trigger 132 is located to allow sufficient space between the side of the cup 105 and the trigger 132 for a user's fingertip. Using a fingertip, a user may urge the trigger 132 towards the vertical segment 130. Such urging deflects the beam 136 downwardly. Such downward deflection causes the notch 134 to separate from the flange 144. Then, the handle may be separated from the cup 105.

Removal of the handle is advantageous. With the handle 120 removed, the cup 105 may be placed in a cup holder without interference from the handle 120. Additionally, removal of the handle 120 may facilitate packaging of the product for sale. By way of example, the handle 120 may be stored within the cavity 110 of the cup 105 for packaging.

In another embodiment, a pair of parallel cantilever beams 200, 210 extend radially from the side of the cup 105. Each such beam 200, 210 includes a bar 202 and a flange 204 at the free end of the beam 202. The flanges of the two cantilever beams 200, 210 extend in opposite directions.

The horizontal segment 125 of the handle 120 is hollow. A pair of apertures 215 is formed on opposite sides of the horizontal segment 125 of the handle 120. When the handle 120 is attached to the cup 105, the pair of parallel cantilever beams 200, 210 is received in a compartment 182 in the horizontal segment 125 of the handle 120, and the flange 204 of each cantilever beam 200, 210 extends into and is received in one of the apertures 215. The flanges 204 thus prevent removal of the handle 120.

To remove the handle 120, the flanges 204 may be urged towards the center of the compartment 182 in the horizontal segment 125 of the handle 120. One flange 204 may be urged inwardly and dislodged from the aperture 215, while the handle 105 is slightly yawed. Then the opposite flange 204 may be urged inwardly and dislodged from the aperture 215, while the handle 120 is pulled apart from the cup 105. A tool, such as a flathead screwdriver may be used to push the flanges 204. Thus, in this embodiment, the handle 120 may be removed, with some effort.

Figure 12:
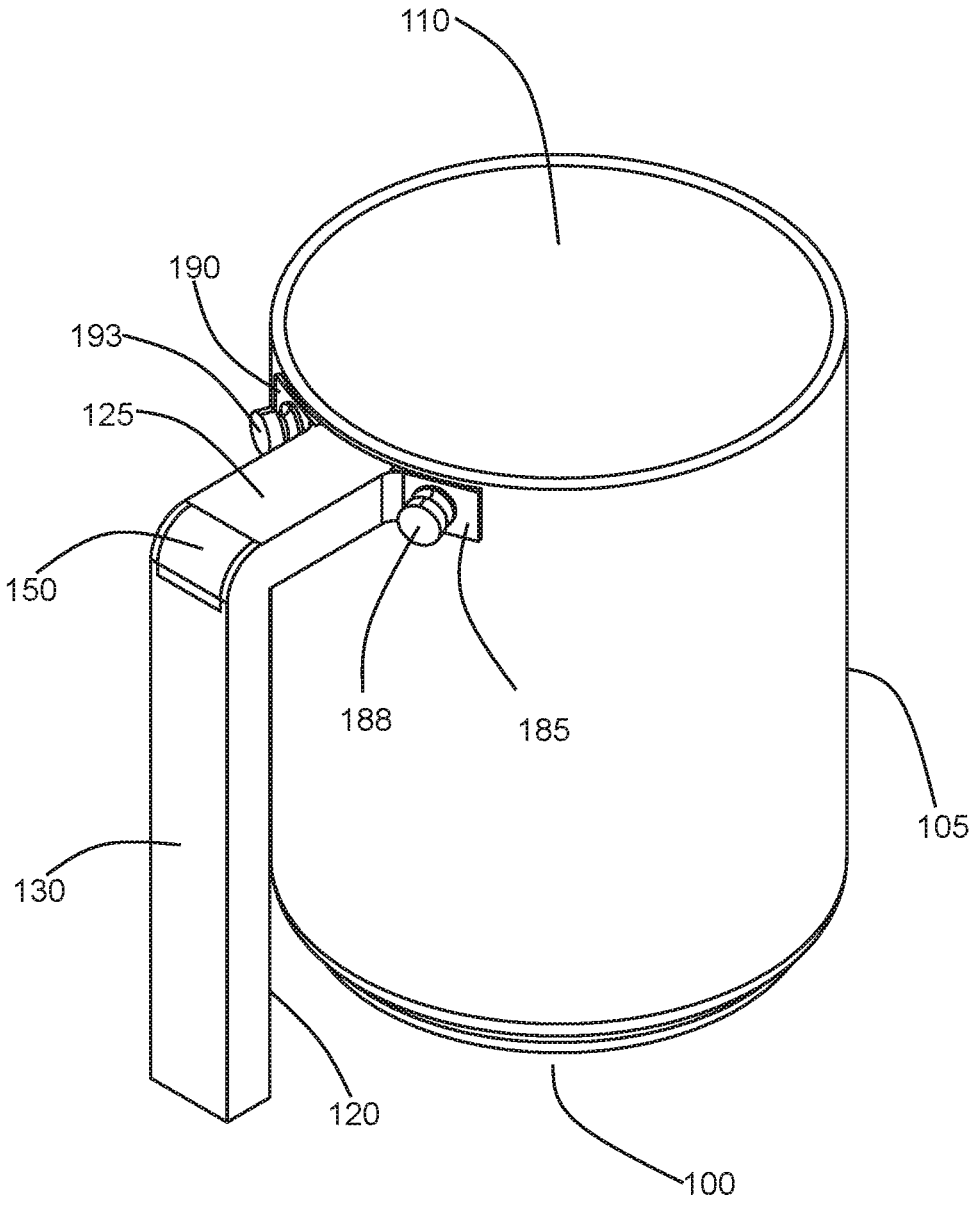
FIG. 12 is a perspective view of another exemplary removable handle attached to an exemplary drinking cup according to principles of the invention.

The invention is not limited to the releasable attachments for the handle 120 as described above and conceptually illustrated in FIGS. 7-11B. A permanently attached handle 120 is within the scope of the invention. A removable handle may include other snap fit connections and/or mechanical fasteners (e.g., flanges with screw holes and attaching screws) without departing from the scope of the invention. As conceptually illustrated in the exemplary embodiment of FIG. 12, the free end of the horizontal segment 125 of the handle 120 includes a pair of flanges 185, 190. The flanges 185, 190 abut the outer side of the cup 105 when the handle is installed. The flanges 185, 190 are removably attached to the cup with screws, such as thumbscrews 188, 193. Each thumbscrew 188, 193 extends through a hole in each flange 185, 190. The thumbscrews 188, 193 thread into a threaded insert molded into the side of the cup 105 at the attachment points. In this embodiment, a users loosens the thumbscrews 188, 193 from the cup 105 to remove the handle, and tightens the thumbscrews to the cup 105 to attach the handle 120. Each thumbscrew 188, 193 may include an internal tooth lock washer, or other mechanism, fitted to its threaded shank to resist separation of the thumbscrew from the flange 185, 190, even when the handle 120 is detached from the cup 105. In this embodiment, when the handle 120 is removed, no structure protrudes from the outer sidewall of the cup 105.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A drinking cup assembly comprising:

a cup including a bottom, an open top leading to a volume for containing a liquid, and a sidewall extending from the bottom and defining the volume and the open top, the sidewall having an inner side and an outer side;

a handle including a first segment extending radially from the outer side of the sidewall, the first segment including a proximal end attached to the sidewall and a distal end opposite the proximal end, and a second segment extending downwardly from the distal end of the first segment, the second segment having a top connected to the first segment and a bottom opposite the top, and the second segment having an interior compartment, and the top of the second segment including an opening leading to the interior compartment, the opening including a first edge at the distal end of the first segment and a second edge at the top of the second segment, and each of the first segment and the second segment of the handle having an outer surface; and a utensil including a panel and a utensil body attached to and extending from the panel, the utensil body being sized to fit in the interior compartment of the second segment, and the panel being sized and shaped to occupy the opening leading to the interior compartment when the utensil body is contained in the interior compartment of the second segment.

2. The drinking cup assembly according to claim 1, the panel forming a portion of the handle when the utensil body is contained in the interior compartment of the second segment.

3. The drinking cup assembly according to claim 1, the panel being curved and forming a transition from the first segment of the handle to the second segment of the handle when the utensil body is contained in the interior compartment of the second segment.

4. The drinking cup assembly according to claim 1, the handle having a width at the top of the second segment, and the opening having a width, and the width of the opening not exceeding the width of the top of the second segment.

5. The drinking cup assembly according to claim 1, the opening including a proximal edge, a distal edge and a pair of spaced apart side edges, the pair of side edges extending from the proximal edge to the distal edge, and each of the proximal edge and distal edge having an elevation; and the panel including a proximal edge, a distal edge and a pair of spaced apart side edges, the pair of side edges extending from the proximal edge to the distal edge, and each of the proximal edge and distal edge having an elevation; and the elevation of the proximal edge of the opening being about the same as the elevation of the proximal edge of the panel when the utensil body is contained in the interior compartment of the second segment.

6. The drinking cup assembly according to claim 5, the elevation of the distal edge of the opening being about the same as the elevation of the distal edge of the panel when the utensil body is contained in the interior compartment of the second segment.

7. The drinking cup assembly according to claim 1, the first segment of the handle being solid.

8. The drinking cup assembly according to claim 1, the first segment of the handle being hollow.

9. The drinking cup assembly according to claim 1, the handle being permanently attached to the sidewall of the cup.

10. The drinking cup assembly according to claim 1, the handle being removably attached to the sidewall of the cup with an attachment.

11. The drinking cup assembly according to claim 10, the attachment comprising a snap-fit coupling.

12. The drinking cup assembly according to claim 10, the attachment comprising a flange and a screw.

13. The drinking cup assembly according to claim 1, the utensil body comprising a stirrer.

14. The drinking cup assembly according to claim 1, the utensil body comprising an implement from the group consisting of a stirrer, a fork, a spoon and a knife.

15. The drinking cup assembly according to claim 1, the utensil body being permanently attached to the panel.

16. The drinking cup assembly according to claim 1, the utensil body being releasably attached to the panel.

17. The drinking cup assembly according to claim 1, the sidewall including at least two spaced apart layers.

18. The drinking cup assembly according to claim 1, the sidewall consisting of a single layer.

19. The drinking cup assembly according to claim 1, the handle further comprising a stop at the opening, the stop limiting insertion of the panel into the opening.

20. The drinking cup assembly according to claim 1, the panel forming a portion of the handle when the utensil body is contained in the interior compartment of the second segment, and, the panel being curved and forming a transition from the first segment of the handle to the second segment of the handle when the utensil body is contained in the interior compartment of the second segment, and the handle having a width at the top of the second segment, and the opening having a width, and the width of the opening not exceeding the width of the top of the second segment; and the opening including a proximal edge, a distal edge and a pair of spaced apart side edges, the pair of side edges extending from the proximal edge to the distal edge, and each of the proximal edge and distal edge having an elevation; and the panel including a proximal edge, a distal edge and a pair of spaced apart side edges, the pair of side edges extending from the proximal edge to the distal edge, and each of the proximal edge and distal edge having an elevation; and the elevation of the proximal edge of the opening being about the same as the elevation of the proximal edge of the panel when the utensil body is contained in the interior compartment of the second segment, and the elevation of the distal edge of the opening being about the same as the elevation of the distal edge of the panel when the utensil body is contained in the interior compartment of the second segment; and the utensil body comprising an implement from the group consisting of a stirrer, a fork, a spoon and a knife; and the handle further comprising a stop at the opening, the stop limiting insertion of the panel into the opening.

* * * * *